United States Patent [19]

Josephson

[11] Patent Number: 5,073,059

[45] Date of Patent: Dec. 17, 1991

[54] VISUAL DISPLAY SUPPORTING STRUCTURE

[76] Inventor: Joseph P. Josephson, 1300 Bloor St. E., Mississsauga, Ontario, Canada, L4Y 3Z2

[21] Appl. No.: 439,803

[22] Filed: Nov. 21, 1989

[51] Int. Cl.[5] ..... B42F 13/00

[52] U.S. Cl. ..... 402/80 R; 40/536; 40/537

[58] Field of Search ..... 402/80 R; 40/530, 536, 40/537; 281/27.2

[56] References Cited

U.S. PATENT DOCUMENTS

| | | | |
|---|---|---|---|
| 286,736 | 10/1883 | Shepard | 40/536 |
| 2,389,511 | 11/1945 | Horr | 40/536 |
| 2,504,355 | 4/1950 | Stader | 40/536 |
| 2,819,546 | 1/1958 | Repholz | 40/536 |
| 2,889,937 | 6/1959 | Best | 40/536 |
| 2,945,594 | 7/1960 | Parker | 40/536 |
| 3,325,934 | 6/1967 | Rhude | 40/536 |
| 4,811,973 | 3/1989 | Kumas-Misir | 281/27.2 |

*Primary Examiner*—Frank T. Yost
*Assistant Examiner*—Hwei-Siu Payer
*Attorney, Agent, or Firm*—McFadden, Fincham, Maracus & Anissimoff

[57] ABSTRACT

The present application discloses a display system for visual display purposes comprising a supporting structure adapted for supporting at least one display pad, the supporting structure having first cooperating releasable retaining pins adapted to releasably hold the pad and having second cooperating releasable retaining apertures adapted to operate in conjunction with the first cooperating releasable pins, the second cooperating releasable aperture being for mounting the pad with the first cooperating releasable pins to the supporting structure. Also disclosed is a display pad which includes a plurality of sheets of material joined together to form the pad, the pad having a first side with binding for securing the first side of the pages of material together along the side and an opposed end provided with second cooperating releasable retaining apertures.

16 Claims, 1 Drawing Sheet

VISUAL DISPLAY SUPPORTING STRUCTURE

BACKGROUND OF THE INVENTION

1. Field of the Invention

This invention relates to visual display systems.

2. Description of Related Art

One technique of displaying material, such as is employed in business meetings or seminars, is to use an easel. Typically, easels are formed of a supporting frame which rests on the floor, and which in turn mount a frame or supporting surface against which writing pads or like material can be secured. When a user writes on the material, since it is in the form of a pad, a page may be flipped or turned over the top of the easel to be temporarily or permanently displaced to permit access to other pages.

In many cases, users will also desire to refer to material which was previously created and to gain access to material which has been turned over, the user must normally stand to the side of the easel to lift up the pages turned over the top of the easel.

The typical pad or material structure that is used for easels is a bound pad provided with binding at the top. This pad is held in place by clips or clamps or other similar ways so that each individual page may be readily lifted up from the bottom of the pad over the top of the easel. Such pads are normally composed of paper for writing with markers or the like and are supplied in sheets of 10 to 50 pages bound by a binder at the top of the pad.

Likewise, easels either have triangular or rectangular mounting feet which require such easels to be spaced apart from a wall. Even if a supporting structure were provided which permitted the easel to be placed closer to a wall structure, the conventional easel use requires that the pages be turned over the top of the easel so that placing the structure against the wall would have little or no advantage in as much as access still has to be provided for permitting the user to retrieve pages which have been turned over the top of the easel.

SUMMARY OF THE INVENTION

With the present invention, Applicant has developed a system for display material, for mounting the same and as well, a new type of pad structure which permits adaptability to a wide variety of circumstances.

More particularly, in accordance with this invention, there is provided in one aspect thereof a display system suitable for mounting on a display stand, the system including a supporting structure adapted for supporting at least one display pad, said supporting structure having at least one, and preferably two or more, spaced apart pins or projections adapted to hold a pad having at least one, and preferably two or more, apertures or cooperating mounting means for mounting to the spaced apart pins or projections of the supporting structure, and in which the display pad includes a plurality of sheets of material joined together to form a pad, the pad having a first edge with means for securing the first edge of the pages of material together and an opposed edge provided with apertures or second cooperating means for mounting the pad to the pins or projections of the supporting structure.

In preferred forms of the invention, two or more display pads can be utilized in the system in which each pad has different characteristics for writing and/or displaying material. More particularly, such pads can be sheets of normal writing paper or graph paper; alternatively, such pads may be formed of a thermoplastic or like material which may have erasable characteristics as well as static properties.

In one particular embodiment, a display system of the present invention will include a pad of normal or conventional paper or graph material and a second pad of differing characteristics in the form of a plurality of sheets of thermoplastic material having erasable and/or static properties.

The pad structures of the present invention are of a special construction compared to conventional pads. As noted above, conventional pads may be provided with a binding which may be a heavier gauge paper, or cardboard binding placed over one end of the sheets and stapled together or otherwise provided with means for securing the binding to the pad.

In contrast to the conventional products, the pads used in the present invention are characterized by not only having a binding or similar structure provided at one end but also, at an opposed end or side with at least one and preferably two apertures for mounting of the pad on the supporting structure. Typically, during use, the apertures of the pad will be mounted at the upper or top part of the supporting structure, meaning that the binding of the pad is at the lower or bottom end of the pad and supporting structure so that in use, once a page has been finished with, it is merely permitted to fall downwardly as opposed to being turned over the top of the supporting structure as in convention procedures.

Thus, in preferred pad structures, one end of the pad is provided with means for retaining the plurality of pages composing the pad and such means may be a binding or adhesive, stapled or other suitable means. The pad of this invention is thus characterized by being provided with apertures at the opposed side of the side of the binding, which in effect, permits mounting of the pad in an upside down manner. This in turn permits the pages to be lowered while being retained by the binding or adhesive joining the pages together.

For various types of applications, and depending on the size of the pad, two or more apertures are normally preferred. Such apertures are conveniently spaced inwardly from the side edges and end or top structure of the pad so as to avoid premature tearing when mounted on the retaining means of the supporting structure.

Another preferred form of the present invention is where the supporting structure comprises a planar supporting surface which in turn, can function as a functional surface besides forming the mounting for the pads. Such a supporting surface would typically be of a size larger than the pads and may be formed from suitable materials such as rigid wood or particle board, solid plastic sheet material, or the like. If it is desired to provide a functional surface for the supporting structure, the surface of the material will be such that it may be provided with erasable characteristics—e.g. as in the case of a plastic surface and moreover, it can be provided in various colours to provide a contrast, if desired, with the writing pads which are otherwise mounted on the supporting surface.

The supporting structure may also be a frame of suitable material, e.g. metal or wood, in which the supporting structure will include the releasable retaining means on a frame component for mounting the top of the pad. A suitable frame structure may be a rectangular frame with one or more intermediate frame members extending between the outer frame to provide the desired supporting area for a pad.

It will be understood that in place of utilizing apertures in the pads at the end opposed to the end of the pad which is bound, special pins or the like can be used to permit the pads to be mounted in cooperating engagement associated with the supporting structure. For example, such pins could extend through the plurality of pages forming the pads into cooperating apertures or receiving means associated with the supporting structure so that each page can be removed, one by one, from the pad by disassociating the page from the pin structure while at the opposed side or end of the pad structure, the binding or other means for securing the individual pages will still retain any page removed from the pin structure integrally with the pad.

The supporting structure may also include suitable means for retaining and/or storing conventional implements used with such display systems—e.g. a storage or supporting shelf for erasers, markers, pens or the like. Such storage shelves can be releasably secured, if desired, for mounting to the supporting structure on one or more sides of the supporting structure, e.g. the top or bottom.

The structure of the present invention has the advantage that it can be mounted either releasably or in a fixedly secured manner to any appropriate substrate or wall structure, and as well, may also be used with any conventional easel frame structure. Thus, by utilizing a display system in which the pages of the pad are permitted to fall by gravity at the front of the device, there is no need to provide a space or gap behind the device so that in the present case the supporting structure can be directly associated with a substrate or wall surface.

Even when using the supporting structure of the present invention with conventional easel frames, the display system still has the advantage that the individual pages of the pads are permitted to fall or project downwardly, thus avoiding the necessity of having to go to the side or even behind an easel to gain access to previously turned over pages for further display purposes.

Having thus generally described the invention, reference will now be made to the accompanying drawings illustrating preferred embodiments and in which:

DESCRIPTION OF PREFERRED EMBODIMENTS

Figure 1:
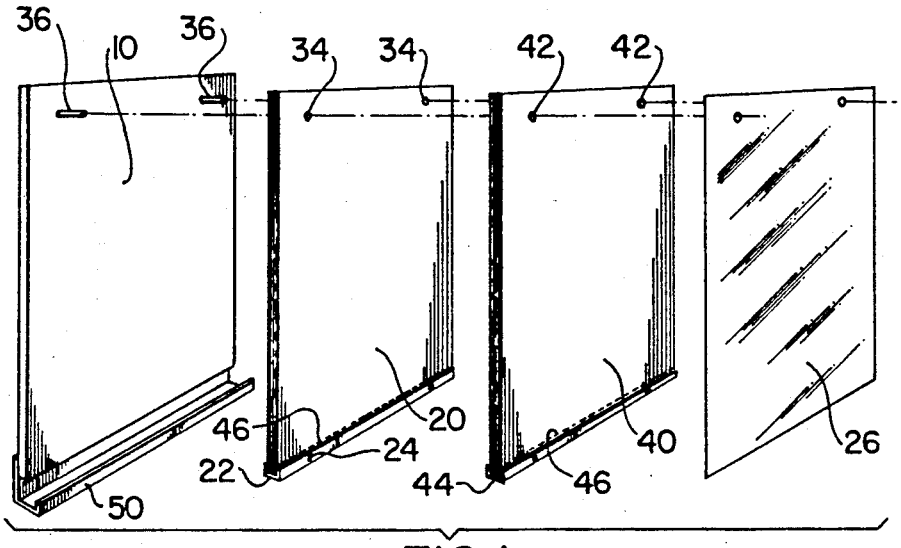
FIG. 1 is an exploded view of a display pad system according to the present invention.

Referring now to the drawings, a display system of the present invention is shown in which a supporting structure is provided as indicated by numeral 10. The supporting structure comprises a substantially rigid sheet material, which may be in the form of a wood panel or a laminate structure. In the embodiment shown, this structure is provided with a plastic surface which has the capability of receiving marker pens and at the same time being erasable once use of the surface is finished with.

The supporting structure 10 is of a generally rectangular configuration but its shape may change for various applications.

A particularly preferred system is illustrated in the drawings which comprises a first pad 20 which is in the form of a plurality of sheets, typically 50 or so, of opaque or white thermoplastic material, e.g. a polypropylene material. These sheets preferably have, in addition to being capable of receiving marking ink, a "static" property which enables them to be written on, removed from the pad 20 and placed on a supporting surface, e.g. wall, where they will stay of their own accord by virtue of their static properties.

The pad 20 includes a conventional binding 22 at the lower end, which fixedly secures the sheets of individual pages or layers together. If desired, according to another embodiment of this invention, two or more spaced apart apertures 24 may be provided extending between the front and back surfaces of the binding 22 and through the individual pages of the pad.

In pad 20, if desired, a first or facing sheet 26 of a clear transparent material of any suitable plastic may be provided so that pad 20 may also function as a "bulletin board" using the static cling properties of the underlying sheets. To this end, by virtue of a transparent cover sheet 26, and with the static properties of the underlying sheet, a notice, sheet or the like can be "adhered" to the underlying sheet beneath the clear facing sheet so that its writing is visible. This is illustrated in FIG. 2 of the drawings, where there is provided an outermost transparent sheet 26 overlying a plurality of individual sheets 28 of thermoplastic opaque material and with a notice in the form of a sheet 32 bearing indicia beneath the transparent sheet 26.

The structure of the pad also includes, at the opposed or top end, a pair of spaced apart apertures 34 which are located inwardly from each of the top and side edges. These apertures may be of any suitable size and typically may be from $\frac{1}{8}$ to $\frac{3}{4}$" or more, being adapted to receive cooperating mounting means associated with the supporting structure.

As shown in FIG. 1, the supporting structure further includes a pair of projecting pins 36 which are arranged on the supporting structure 10 in a spaced apart manner so that the apertures 34 are in registry with the pins 36 when the pad is placed on the supporting structure 10.

Figure 2:
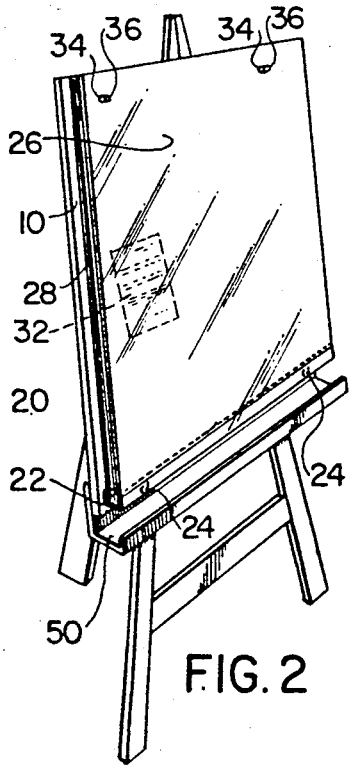
FIG. 2 is shows a perspective view of the display system of the present invention mounted for use.
Figure 3:
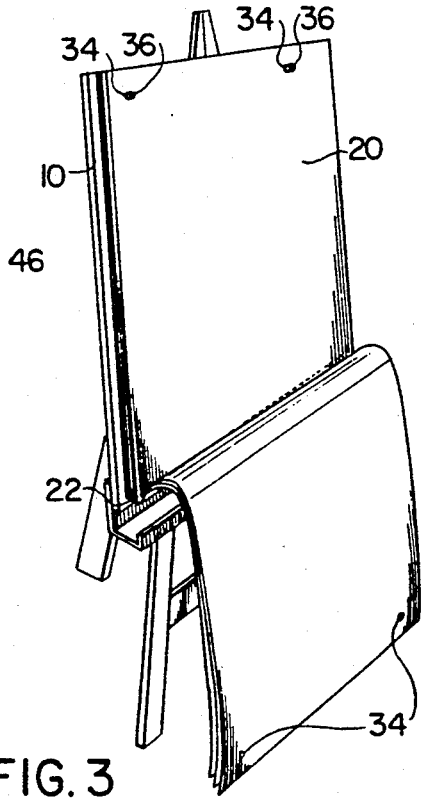
FIG. 3 is a view similar to FIG. 2 showing the display system in use.

In this manner, the arrangement shown in FIGS. 2 and 3 is achieved, where it will be seen that the binding 22 of the pad is located at the lower end, with the pad being actually mounted on the supporting structure via pins 36. In this manner, each page, including the overlay page 26, may be lowered to fall beneath the supporting structure 10, thus exposing a fresh surface for writing and/or display purposes.

A second pad 40 of a different structure, e.g. plain paper is also provided as a separate entity. This pad has a similar structure to that described above and thus includes a pair of spaced apart upper apertures 42 adapted for mounting via the pins 36 to the supporting structure 10 and as well, a binding 44 for retaining the lower end of the pad together so that the individual sheets are not readily separable.

In the pad structure shown above, the pads may be provided with lines of perforation 46 extending adjacent to or at the edge of the binding on the front of the pad so that if desired, individual pages of the pad (for either or both pads) may be removed.

The supporting structure 10 may also be provided with means for storing or retaining accessories and to this end, a suitable shelf 50 may be provided. Shelf 50, in the embodiment illustrated, may be removable by suitable means—e.g., shelf 50 may include a channel at its rear face to permit it to be slidingly engaged with cooperating pins or the like fixedly secured to the supporting structure 10. Such cooperating pins may be provided at the top as well as the bottom of the structure 10.

The above described system thus includes three functions—the surface of the supporting structure 10 becomes a marking board which may be erasable to accept various types of markers; the system utilizes one or more pads as a "flip chart" which are distinguished by their structure enabling individual pages to be lowered beneath the structure 10 and as well, by providing a transparent cover sheet, the system also functions as a bulletin board which securely retains any notice adhered to the static cling pages by virtue of the transparent cover sheet being secured at the top and the bottom.

What is claimed is:

1. A display system for visual display purposes, comprising:

at least one display pad;

a supporting structure adapted for supporting said pad, said supporting structure having cooperating releasable retaining means at a top edge adapted to releasably hold said pad;

said pad having spaced opposed sides and comprising a plurality of sheets of material and means at one of said spaced opposed sides securing said sheets together;

first retaining means at said one of said spaced opposed sides of said pad and second retaining means at the other of said spaced opposed sides of said pad;

perforation means adjacent said securing means;

said first and second retaining means adapted to cooperate with said releasable retaining means of said supporting structure for alternative support said pad with either of said spaced opposed sides at said top edge as desired;

wherein said sheets may be detached from said releasable retaining means and lowered when mounted with said one side at a lower part of said supporting structure, and wherein said sheets may be detached at said perforation means when mounted with said other side at said lower part.

2. A display system according to claim 1, wherein there are at least two display pads, each pad being of a different material than the other.

3. A display system according to claim 1, wherein said pad comprises a first pad of thermoplastic sheet material having static cling properties and a second pad of plain paper material adapted to receive indicia.

4. A display system according to claim 1 wherein said supporting structure comprises a supporting frame adapted to support at least one display pad, said supporting frame having associated therewith said cooperating releasable retaining means.

5. A display system according to claim 4, wherein said supporting structure includes means for retaining and/or storing implements used with said display system.

6. A display system according to claim 5, wherein said means for retaining the implements comprises a releasably secured shelf adapted to be mounted on a bottom of said supporting structure.

7. A display system according to claim 1, wherein said supporting structure comprises a supporting surface adapted to support at least one display pad, said cooperating releasable retaining means being associated with said supporting surface.

8. A display system according to claim 7, wherein said supporting structure comprises a planar supporting panel, said cooperating releasable retaining means being removably mountable on said panel.

9. A display system according to claim 8, wherein said supporting panel includes a writing surface adapted to receive markings.

10. A display system according to claim 1, wherein said cooperating releasable retaining means comprises at least one pin adapted to be mounted in said supporting structure, and said first and second retaining means each comprise a corresponding aperture in said display pad in registry with said cooperating releasable means.

11. A display system according to claim 10, wherein said cooperating releasable means comprises a pair of spaced apart pins, each pin being mountable on said supporting structure at a top side thereof spaced inwardly from a top margin and side margin thereof, and said first and second retaining means each comprise a pair of spaced apart apertures in said display pad.

12. In a display pad having a plurality of display sheets suitable for mounting on a display or supporting structure, the improvement wherein said pad includes means for securing said sheets together along a first side;

first means for releasably securing said pad at said first side to a supporting structure adapted to mount said display pad, and second means for releasably securing said pad at a second side spaced from and opposed to said first side, to the supporting structure;

perforation means adjacent said securing means;

whereby said display pad may be mounted on the supporting structure alternatively with one of said first and second sides at an upper edge of a supporting structure and wherein individual pages of said pad may be releasably detached to permit a page to be lowered while still retained by said securing means when mounted with said first side at a lower edge of the supporting structure, and wherein individual pages may be removed from said pad at said perforation means when mounted with said second side at said lower edge.

13. A display pad as defined in claim 12, wherein said display pad includes a transparent cover sheet, said pad comprising a plurality of individual pages, at least some of which comprise a thermoplastic sheet material having static properties.

14. A display pad as defined in claim 12, wherein said display pad includes a plurality of pages of paper adapted to receive writing indicia.

15. A display pad as defined in claim 12, wherein said display pad comprises a plurality of individual sheets of material joined together at one side thereof forming a bottom for said pad, said sheets being joined by a binding forming said means for securing said sheets together and wherein said first and second means for releasably securing said pad each comprise at least one aperture at said first and second sides of said pad.

16. A display pad as defined in claim 12, wherein said display pad comprises a plurality of individual sheets of material joined together at one side thereof forming a bottom for said pad, said sheets being joined by a binding forming said means for securing said sheets together and wherein said first and second means for releasably securing said pad each comprise a pair of spaced apart apertures at said first and second sides of said pad.

* * * * *